US005145389A

United States Patent [19]

Okubo

[11] Patent Number: 5,145,389

[45] Date of Patent: Sep. 8, 1992

[54] CARD CONNECTOR WITH EJECTOR

[75] Inventor: Isao Okubo, Kawasaki, Japan

[73] Assignee: ITT Corporation, Secaucus, N.J.

[21] Appl. No.: 663,353

[22] Filed: Mar. 4, 1991

[30] Foreign Application Priority Data

Apr. 17, 1990 [JP] Japan ..... 2-99434

[51] Int. Cl.[5] ..... H01R 13/62

[52] U.S. Cl. ..... 439/159; 439/152

[58] Field of Search ..... 439/152-160, 439/372, 476, 483, 329

[56] References Cited

U.S. PATENT DOCUMENTS 4,778,401 10/1988 Boudreau et al. ..... 439/157
4,952,161 8/1990 Komatsu ..... 439/159
5,011,420 4/1991 Sakamoto ..... 439/152

*Primary Examiner*—David L. Birlot
*Attorney, Agent, or Firm*—Thomas L. Peterson

[57] ABSTRACT

A card connector is provided which avoid jamming and twisting of a closely guided card (10) during card ejection. The connector includes a frame (7) that closely slideably guides the card and an ejector (4) with parts (18) that engage opposite sides of the rear edge of the card to eject it. A lever (5) pivotally mounted on the frame has one end connected to a rearwardly movable ejector button (3) and an opposite end pivotally connected to the ejector, so rearward movement of the button causes forward movement of the ejector. The ejector is slidably mounted on the frame to move accurately in rearward and forward directions to avoid jamming and twisting of the closely guided card.

4 Claims, 4 Drawing Sheets

FIG. 2
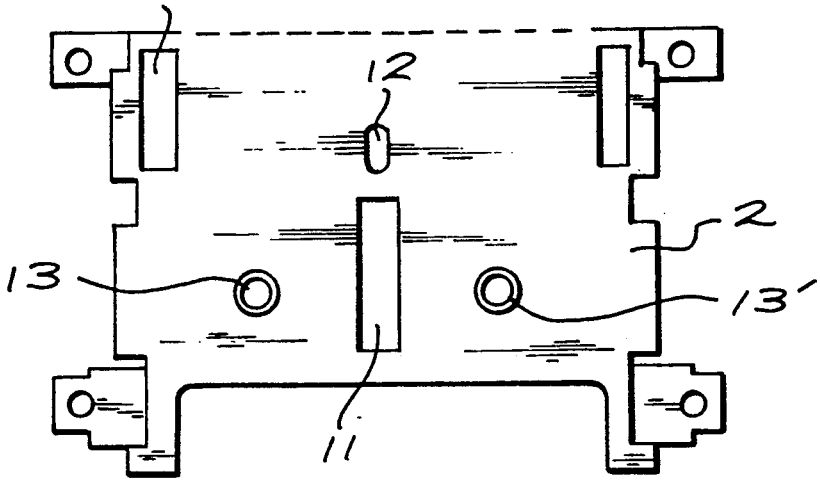
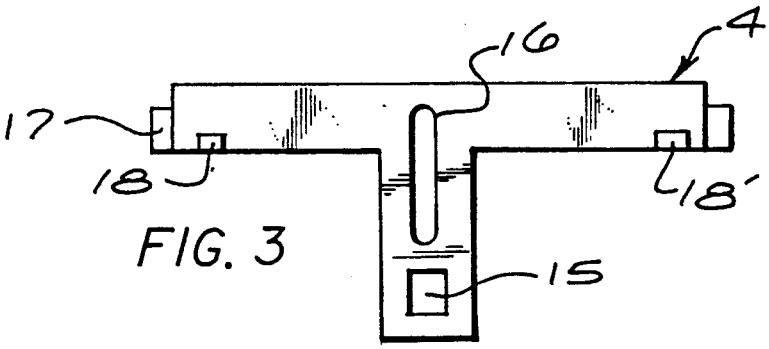
FIG. 3
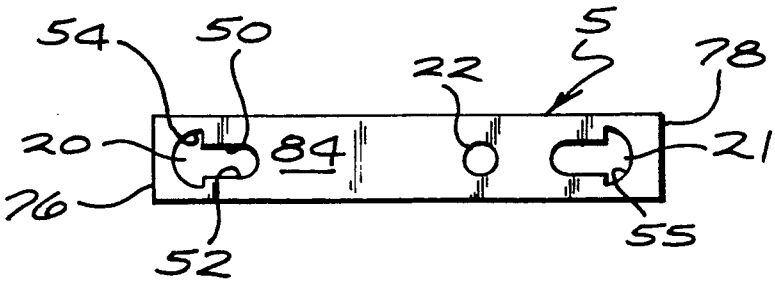
FIG. 4
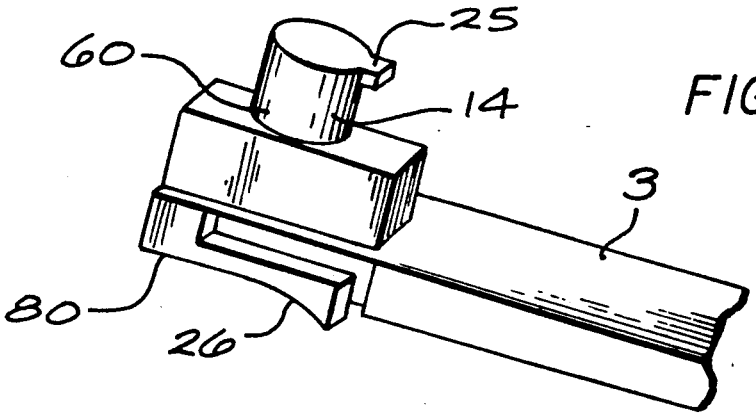
FIG. 5

FIG. 6
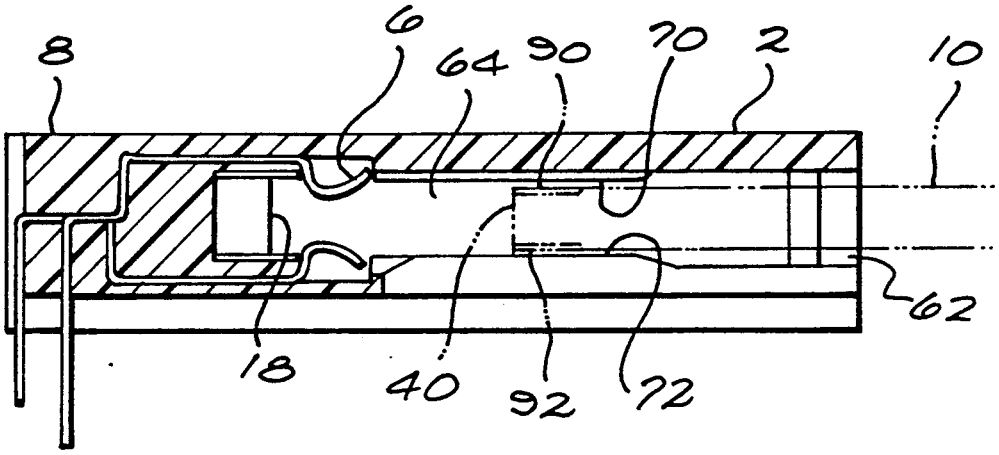
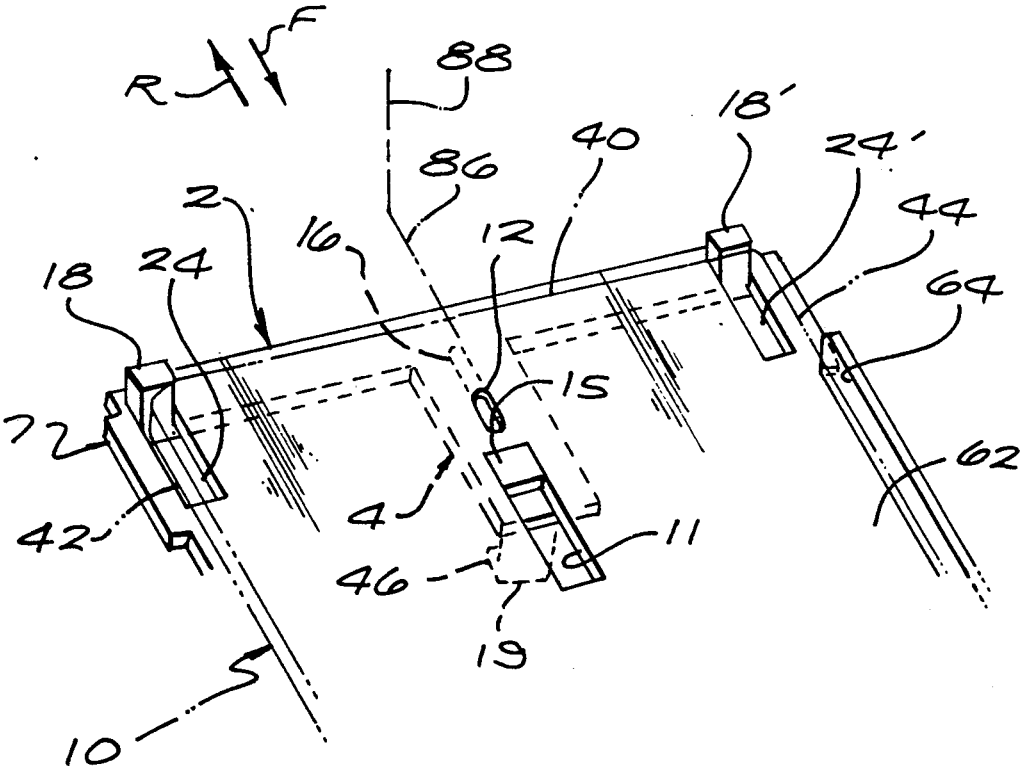
FIG. 7

CARD CONNECTOR WITH EJECTOR

BACKGROUND OF THE INVENTION

A common type of card connector includes a cavity into which a card is inserted, until contact pads near on the rear of the card engage terminals of the card connector. The card cavity may be constructed so that the front edge of the card does not project, or does not project far, out of the frame to assure close guiding of the card and avoid tampering with it while it is connected. An ejector mechanism includes a button which is depressed to move rearwardly, and which is connected through a linkage to an ejector which pushes against the rear edge of the card. The ejector moves the card far enough so a person can grasp the card to pull it out. Recently, card contacts have been placed very close together, and the card has been very closely guided into position to assure proper engagement of the card contact pads with the terminals. Commonly used ejector mechanisms do not move the card rearwardly with sufficient precision to avoid jamming and consequent twisting of the card. An eject mechanism which ejected the card in a precisely controlled symmetrical manner would be of considerable value.

SUMMARY OF THE INVENTION

In accordance with one embodiment of the present invention, a card connector with ejector is provided, wherein the ejector mechanism accurately moves the card forwardly to avoid jamming and twisting of the card. The card connector includes a frame with walls forming a card-receiving cavity with the walls that closely guide the opposite side edges of the card in forward and rearward movement. An ejector mechanism includes an ejector button that can be depressed to move it rearwardly, an ejector that moves forwardly against the rear edge of the card, and a lever pivotally mounted on the frame and having opposite ends pivotally coupled respectively to the ejector button and to the ejector. The ejector is slideably mounted on the frame, independently of the lever that moves it, to move accurately in rearward and forward directions. The ejector has a pair of spaced parts located to abut opposite sides of the rear edge of the card, to move both sides of the rear edge simultaneously forward during ejection.

The novel features of the invention are set forth with particularity in the appended claims. The invention will be best understood from the following description when read in conjunction with the accompanying drawings.

BRIEF DESCRIPTION OF THE DRAWINGS

FIG. 2 is a bottom view of a housing member of the frame of the card connector of FIG. 1.

FIG. 3 is a plan view of the ejector of the card connector of FIG. 1.

FIG. 4 is a plan view of the lever of the card connector of FIG. 1.

FIG. 5 is a perspective view of the rear portion of the button of the card connector of FIG. 1.

FIG. 6 is a partial sectional view taken on the line 6—6 of FIG. 1.

FIG. 7 is a partial top perspective view of the card connector of FIG. 1.

DESCRIPTION OF THE PREFERRED EMBODIMENT

Figure 8:
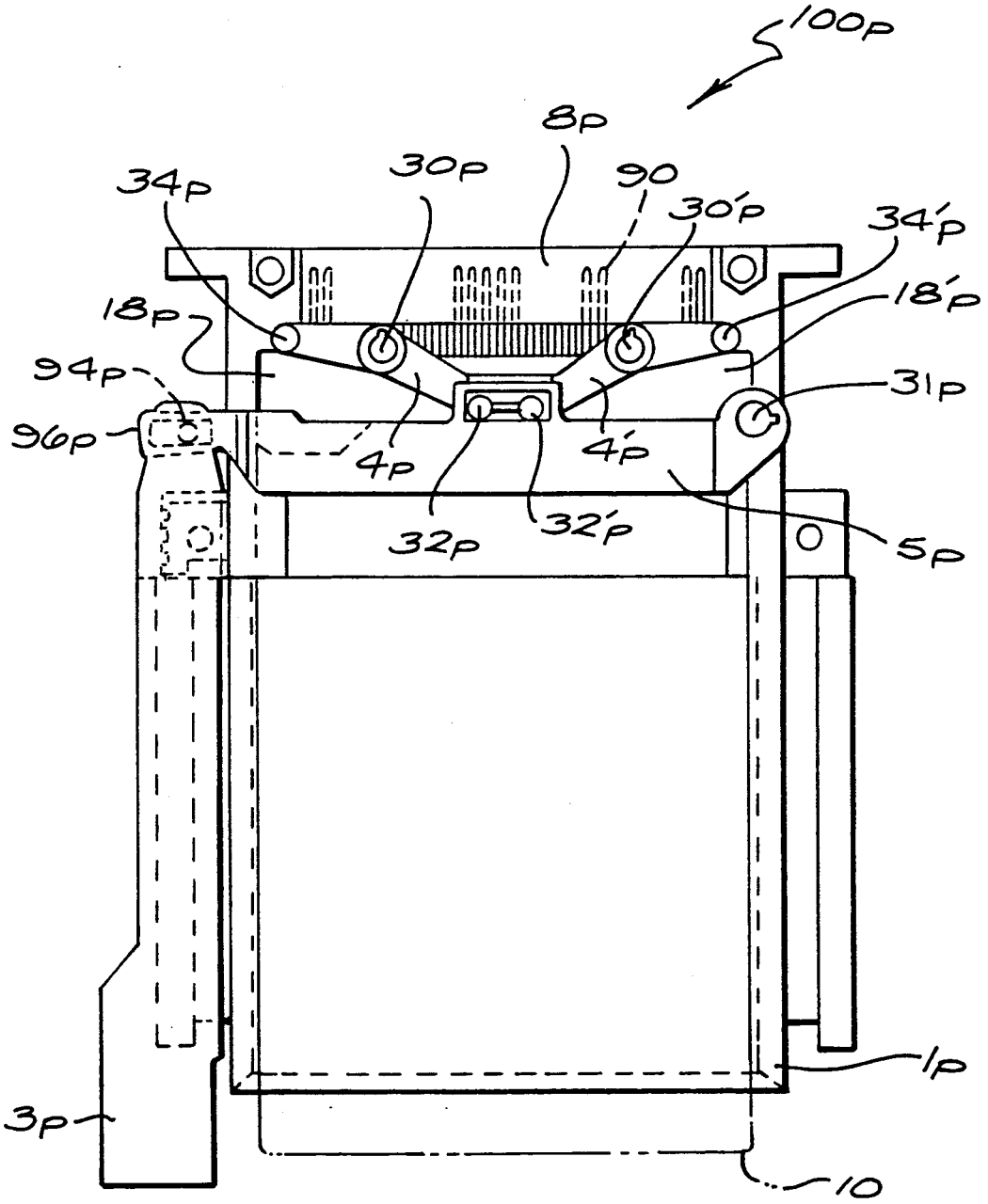
FIG. 8 PRIOR ART
FIG. 8 is a bottom view of a card connector constructed in accordance with the prior art.
Figure 8:
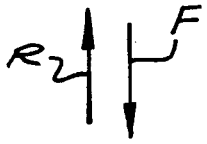
FIG. 8 PRIOR ART

FIG. 8 illustrates a prior art card connector 100*p* designed to receive a card 10 of the type that includes integrated circuits connected to multiple contact pads such as 90 on a face of the card near its rear edge. When the card is fully inserted, the contact pads 90 engage terminals 8*p* of the connector.

To eject the card, an eject button 3*p* is depressed, or moved in a rearward direction R. The button is slideably mounted on a frame 1*p* of the connector. When the button is moved rearwardly, a shaft 94*p* on the button moves a rear end 96*p* of a lever 5*p* which is pivotally mounted about an axis 31*p*. The middle of the lever is engaged with ends 32*p*, 32'*p* of arms 4*p*, 4'*p* whose middles are mounted at axes 30*p*, 30'*p*. As the eject button is depressed, it pivots the arms so their opposite ends 34*p*, 34'*p* press against the rear edge of the card near locations 18*p*, 18'*p*. This causes the card to be ejected in a forward direction F, far enough for a person to grasp the forward end of the card and pull it out of the cavity. It is noted that as the button is depressed, the end 32*p* of the arm 4*p* is moved rearwardly slightly further than the end 32'*p* of the arm 4'*p*. This causes the card location 18*p* to be pressed rearwardly slightly more than the other side. This can lead to jamming of the card so it cannot move forwardly, and can result in further force by the arm end 34*p* causing twisting of the rear end of the card and consequent damage to it.

Figure 1:
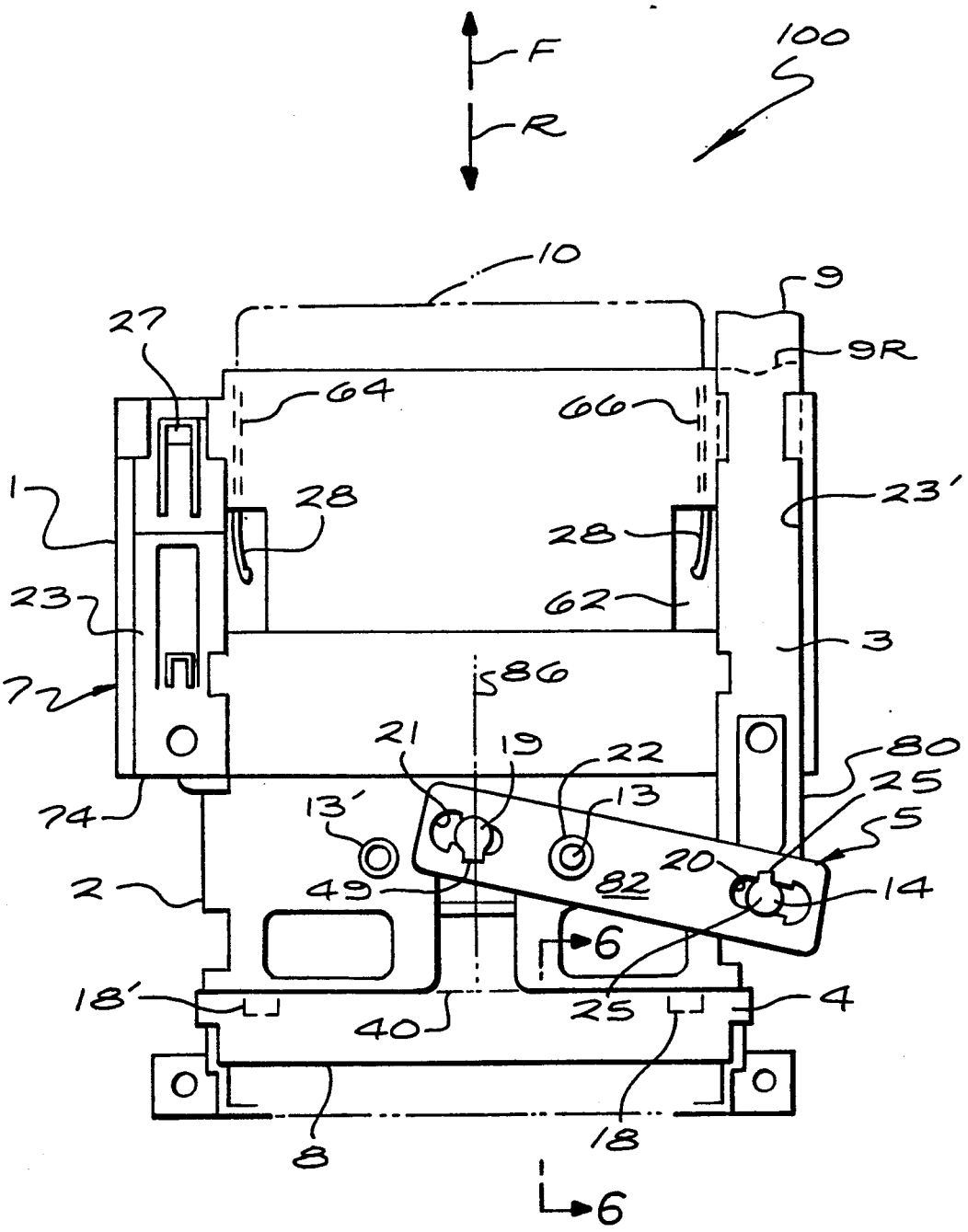
FIG. 1 is a bottom view of a card connector constructed in accordance with one embodiment of the present invention, with the card fully installed.

FIG. 1 illustrates a card connector 100 of the present invention, which avoids jamming of the card during ejection. The connector has a frame 7 that includes a frame member 1 and a housing member 2 mounted on the frame member. An ejector 4 is slideably mounted on the housing member 2 to slide in a forward direction F to eject a fully inserted card 10. A push button 3 that is slideably mounted on the frame has a front end that can be moved from an extreme front position 9 to an extreme rear position 9R. The button has a rear end connected to a lever 5 whose middle is pivotally connected on the frame by a shaft 13. The opposite end of the lever 5 is pivotally connected to the ejector 4. When the ejector button 3 is depressed, or moved rearwardly, it causes pivoting of the lever 5 so as to move the ejector 4 forwardly. At that time, card engaging parts 18, 18' on the ejector press against the rear edge 40 of the card to eject it.

As shown in FIG. 7, the card engaging parts 18, 18' of the ejector, project through slots 24, 24' formed in the housing member 2, and project upwardly above the top surface of the housing member 2 so as to engage the rear edge 40 of the card. The ejector 4 also has an upwardly extending projection 15 which is slideably engaged with the walls of a groove 11, that is also formed in the housing member 2 to accurately guide the ejector in forward and rearward movement. The projection 15 is spaced forwardly, in a direction F, of the card-engaging projections 18, 18', so as to prevent appreciable tilt of the ejector about vertical axes such as indicated by line 88. The projection 15 lies on a center plane 86 that lies half-way between the projections 18, 18'. It may be noted that slideable engagement is also obtained by a depression 12 formed in the housing member 2, which engages a groove 16 in the ejector 4. By thus preventing substantial tilt of the ejector about a vertical axis, applicant avoids jamming either side edge 42, 44 of the card against a card edge guide wall such as 64 of the frame.

Referring again to FIG. 1, the frame 7 forms guide grooves 23, 23' at its opposite sides, each of which can slideably support the eject button 3. To mount the eject button at a particular side, the rearward end 80 of the eject button is inserted into a groove such as 23', and moved partially rearward. The lever 5 is then installed on the frame by aligning a hole 22 in the lever with a shaft 13 on the frame. Then shafts 25, 19 of the button and ejector, respectively, are projected through holes 20, 21 at the opposite ends of the links. Before the button is slid completely rearwardly, an enlarged tip 25 (FIG. 5) on the shaft lying at the rear end 80 of the button can project through a hole enlargement 54 (FIG. 3) of the lever hole 20. A similar enlarged tip on the ejector shaft 19 can project through an enlargement 55 in the lever end that couples to the ejector. When the button is moved further rearwardly, far enough to be trapped in place, the shaft enlarged tip 25 lies in a narrow straight-sided slot 52 of the hole 20, and cannot pull out of position. Then, an axle portion 60 (FIG. 5) on the shaft 25 pivots within the slot 52 in the lever. Similarly, an enlarged tip 49 on the ejector shaft 19 traps an adjacent end of the lever.

When the button is pressed rearwardly far enough, a stopper 26 (FIG. 5) at the rear end of the button passes across a stopper edge 74 (FIG. 1) which traps the button in place.

In order to prevent an inserted card from falling out, the frame is provided with resilient arms 28 that press against the opposite side edges of the card to create friction that resist card movement.

As shown in FIG. 6, the card has contact pads 90, 92 near its rear edge 40, on its opposite faces, which are engaged with terminals 6 of the card connector termination 8.

Thus, the invention provides a card connector with an ejector that moves accurately along a forward direction parallel to card edge guides, to avoid jamming and twisting of the card. The ejector is pivotally connected through a lever to an eject button for low friction transmission of motion, but the ejector itself is accurately slideably mounted on the connector frame to move in forward and rearward directions. The ejector has a pair of card engaging parts that engage the rear edge of the card adjacent its opposite card side edges. These card-engaging parts also move along grooves in the frame which guide them in slideable movement. The ejector also has a middle part lying forward of the card engaging parts, which is also slideably engaged with the frame, to thereby prevent substantial tilting of the ejector. The lever that connects the button to the ejector, has holes that receive shafts on the button and ejector, with one end of each hole being enlarged to receive an enlargement on the button or ejector shaft, and with the rest of each hole forming a slot with parallel walls.

Although particular embodiments of the invention have been described and illustrated herein, it is recognized that modifications and variations may readily occur to those skilled in the art, and consequently it is intended that the claims be interpreted to cover such modifications and equivalents.

I claim:

1. A card connector for use with a card having a rear edge and opposite side edges comprising:

a frame which includes a cavity for receiving said card and walls for closely guiding said card in movement rearwardly into said cavity and forwardly out of said cavity;

an ejector movably mounted on said frame and having card engaging portions positioned to engage said rear edge of said card when said card is fully inserted into said cavity;

a depressible ejector button movably mounted on said frame;

a lever pivotally mounted on said frame and having first and second parts pivotally coupled respectively to said button and to said ejector, so depression of said button causes movement of said ejector in a forward direction to eject said card;

said ejector having first and second spaced locations that are each slidably mounted directly on said frame to move accurately in said rearward and forward directions, and said card engaging parts include two spaced parts located to abut said card rear edge at locations thereon lying adjacent to the opposite side edges of the card;

said first and second locations being spaced apart by more than half the width of said card;

said spaced parts which engage said card rear edge are each slidably mounted on said frame to form said first and second locations that are each slidably mounted on said frame.

2. The card connector described in claim 1 wherein:

said spaced parts which engage said card rear edge are each slidably mounted on said frame to form said first and second locations that are each slidably mounted on said frame.

3. The card connector described in claim 1 wherein:

said first and second locations are spaced apart along a direction perpendicular to the direction of said card movement;

said ejector is separately slidably mounted on said frame at said first and second locations and also at a separate third location spaced forward of said first and second locations, with each of said locations including apart slidably received in a separate groove extending in said forward and rearward directions.

4. A card connector for use with a card having a rear edge and opposite side edges comprising:

a frame which includes a cavity for receiving said card and walls for closely guiding said card in movement rearwardly into said cavity and forwardly out of said cavity;

an ejector movably mounted on said frame and having card engaging parts positioned to engage said rear edge of said card when said card is fully inserted into said cavity;

a depressible ejector button which is slidably mounted on said frame to move in said rearward and forward directions between extreme rearward and forward positions;

a lever pivotally mounted on said frame and having first and second parts pivotally coupled respectively to said button and to said ejector, so depression of said button causes movement of said ejector in a forward direction to eject said card;

said ejector being slidably mounted directly on said frame to move accurately in said rearward and forward directions, and said card engaging portions include two spaced parts located to abut said card rear edge at locations thereon lying adjacent to the opposite side edges of the card;

said button includes a rearward end having a shaft extending perpendicular to said forward and rearward directions and having an enlarged tip;

said lever has a hole that receives said shaft and which can pivot thereon, said lever having first and second faces;

said button is installable on said frame by moving said button rearwardly into said frame until said button passes said most forward position, said button and frame having stopper parts that normally prevent forward movement of said button forwardly past said extreme forward position;

said lever hole is elongated and has a wide first end which is positioned to receive said tip of said shaft only when said button lies forward of said extreme forward position.

* * * * *